United States Patent [19]

Dietterich et al.

[11] Patent Number: 4,991,299

[45] Date of Patent: Feb. 12, 1991

[54] UNIVERSAL CRAYON SHARPENER

[75] Inventors: Charles W. Dietterich, Brodheadsville; Gregory C. Yehl, Wescosville; Harry J. Lidle, Jr., Macungie, all of

[73] Assignee: Binney & Smith Inc., Easton, Pa.

[21] Appl. No.: 420,583

[22] Filed: Oct. 12, 1989

[51] Int. Cl.[5] ..... B43L 23/00

[52] U.S. Cl. ..... 30/453; 30/454; 30/455

[58] Field of Search ..... 30/453, 454, 455, 462, 30/457; 144/28.11, 28.2

[56] References Cited

U.S. PATENT DOCUMENTS

| | | | |
|---|---|---|---|
| 338,904 | 3/1886 | Worn | 30/462 |
| 1,270,119 | 6/1918 | Conover | 30/457 |
| 2,502,177 | 3/1950 | Sigman | 30/454 |
| 2,857,881 | 6/1957 | Beebe et al. . | |

OTHER PUBLICATIONS

A Sample of a "Double Crayon Sharpener," and its display card purchased from F. W. Woolworth Co, it is believed that this device was offered for sale more than one year before Oct. 12, 1989.

A RoseArt brand "Double Crayon Sharpener" and display card. It is believed that this device was offered for sale more than one year before Oct. 12, 1989.

Photographs of a "Color 'n Turn" device depicting the device and the display card. It is not known whether this device was offered for sale or in public use more than one year before Oct. 12, 1989.

*Primary Examiner*—William E. Terrell
*Assistant Examiner*—M. Rachuba
*Attorney, Agent, or Firm*—Neuman, Williams, Anderson & Olson

[57] ABSTRACT

The invention provides a single, universal crayon sharpener capable of accommodating many different sizes of crayons or other similar marking instruments. The invention includes asymmetrical sharpening slots and cutting flanges which cooperate with an internal guide wal to ensure the proper placement and sharpening of a large range of crayon sizes. The use of asymmetrical sharpening slots and cutting flanges, and an internal guide wall, in addition, permits the efficient reinforcement of the sharpener to resist the forces and stresses generated during the sharpening process.

18 Claims, 3 Drawing Sheets

Fig. 1
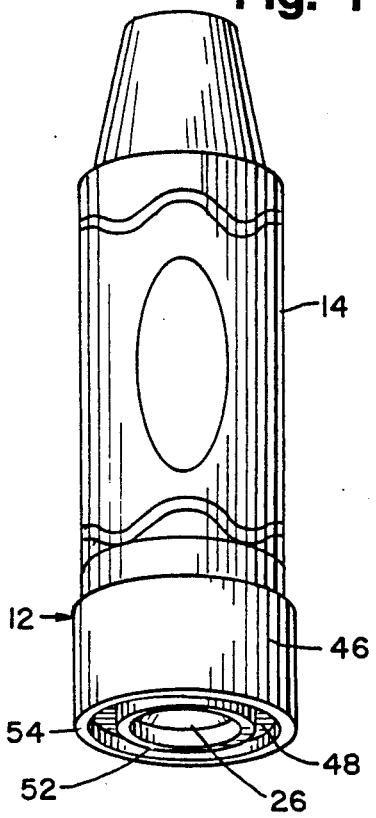
Fig. 4
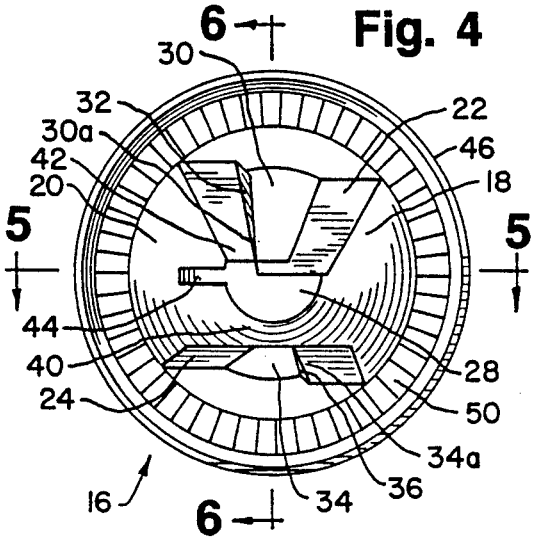
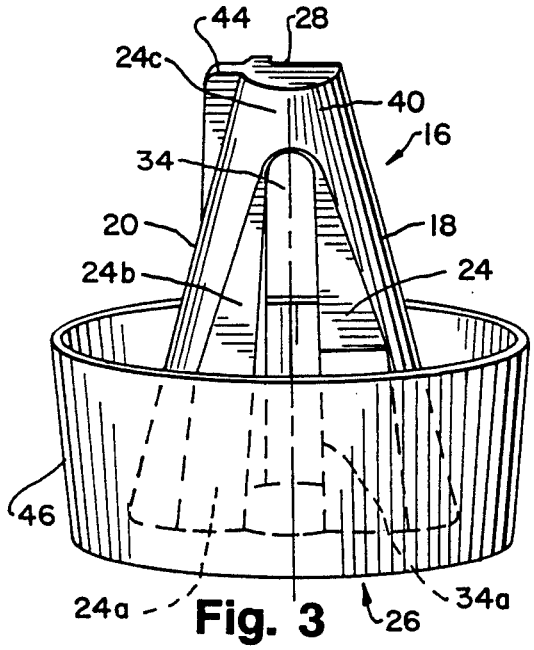
Fig. 3
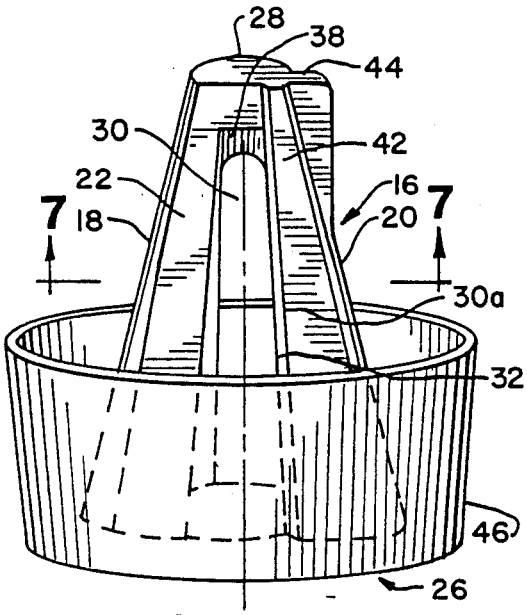
Fig. 2

Fig. 5
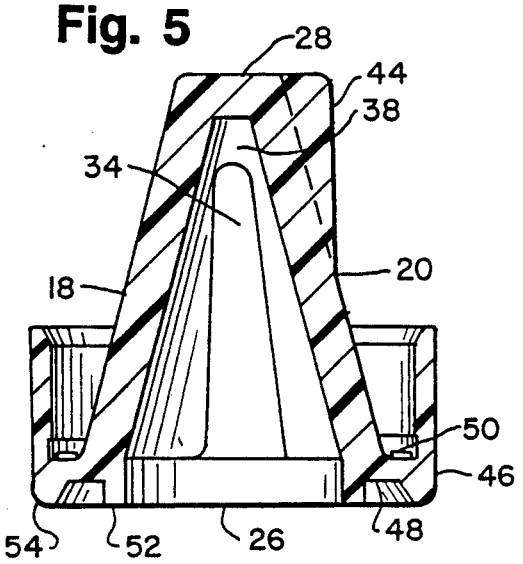
Fig. 6
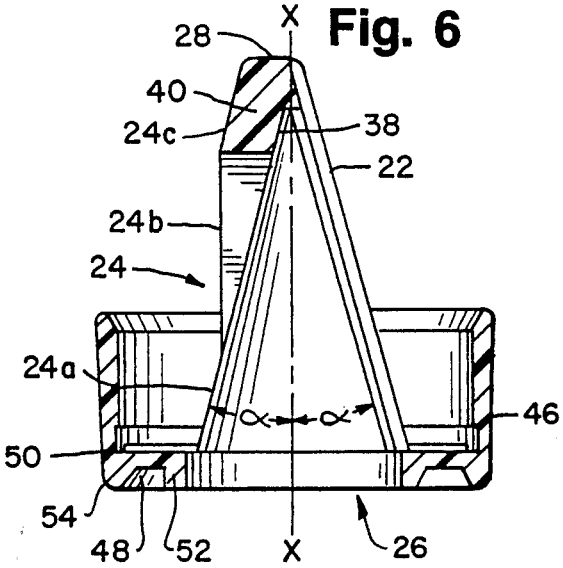
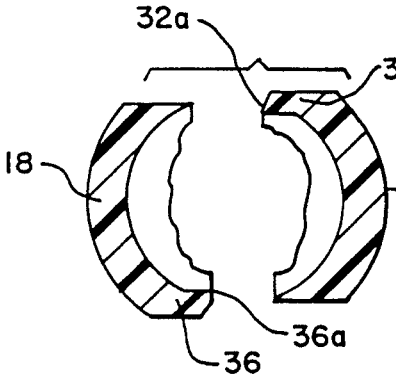
Fig. 7
Fig. 8
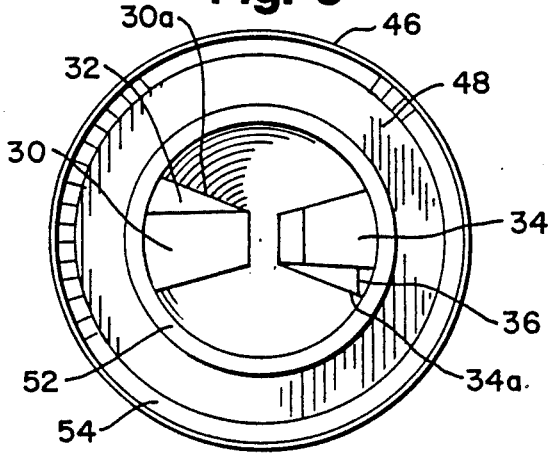
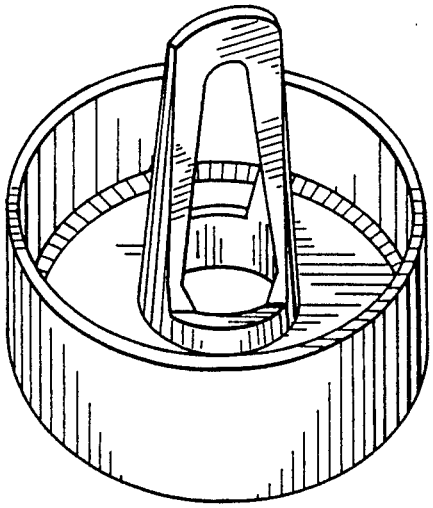
Fig. 12
PRIOR ART

UNIVERSAL CRAYON SHARPENER

FIELD OF THE INVENTION

This invention is directed to sharpening devices for crayons and similar marking instruments, that is, marking instruments made from waxes, plastics or other such materials.

BACKGROUND OF THE INVENTION

The prior art sharpening devices for crayons and similar marking instruments typically included a conical housing with two flat, angled walls provided with symmetrical sharpening elements extending from the base of the housing substantially to its apex. These sharpening elements usually comprised rectangular openings sized so that the edges of the openings engaged and shaved the surface of a crayon pressed into the openings.

To sharpen a crayon in the prior art devices, one inserted the crayon into the sharpener and rotated the crayon while simultaneously pressing the crayon into the sharpening openings. As the crayon rotated, the edges of the sharpening openings removed a thin layer of wax, plastic or similar material from the surface of the crayon, giving the crayon a smooth, pointed, conical shape suitable for marking or coloring. The shavings would then pass through the sharpening openings into an optional collection receptacle. An example of such a sharpener is illustrated in FIG. 12 herein.

Crayons and similar marking instruments are sold in a wide variety of sizes. For example, the CRAYOLA brand round wax crayons sold by Binney & Smith Inc. range from 0.360 inches to 0.570 inches in diameter. The prior art sharpeners, however, were not designed to sharpen all crayon sizes within such a range. On the contrary, the prior art sharpeners were usually limited to a predetermined crayon size. They could not accommodate crayons with a larger diameter and did not satisfactorily sharpen crayons with a smaller diameter.

In particular, sharpeners designed for relatively large crayons often lacked sufficient means for ensuring that small crayons were held in the proper sharpening position. Thus, it was frequently difficult to sharpen small crayons to the proper dimensions without breaking or cracking their tips during the sharpening process. Simply expanding the dimensions of sharpeners intended for small diameter crayons to accommodate larger diameter crayons was also unsuccessful as these devices lacked the structural strength to resist the forces and stresses generated while sharpening large crayons.

As a result, a number of separate and individual sharpening devices tailored for each crayon size, or a series of such sharpening devices mounted in a single unit, were required to sharpen the range of commercially available crayons. This was both inconvenient and impractical, particularly for young children (frequently heavy crayon users) who were required to identify and keep track of the particular sharpener which matched each of the presently available crayon sizes.

The present invention provides a single, universal crayon sharpener which, unlike those of the prior art, will sharpen from relatively large diameter crayons (e.g. 0.570 inches in diameter) to relatively small diameter crayons (e.g. 0.360 inches in diameter). The sharpener of the invention employs asymmetrical sharpening means and internal guide means to ensure that crayons of many different sizes may be efficiently and properly sharpened to the correct dimensions, thus eliminating the need for multiple sharpeners of different sizes.

The invention, in addition, provides a universal sharpener that may be reinforced to withstand the pressures and forces generated during the sharpening of relatively large crayons or other difficult to sharpen marking instruments. Furthermore, the invention provides a sharpener that is cost efficient and simple to manufacture.

OBJECTS OF THE INVENTION

It is an object of the invention to provide an improved crayon sharpener capable of accommodating a wide range of crayon sizes.

It is also an object of the invention to provide an improved crayon sharpener with improved strength and durability.

It is a further object of the invention to provide an improved crayon sharpener that is cost efficient and simple to manufacture.

Other objects, advantages and features of the present invention will become apparent upon reading the following detailed description and appended claims and upon reference to the accompanying drawings.

SUMMARY OF THE INVENTION

The invention provides a universal crayon sharpener for many different sized crayons or other similar writing instruments. The invention includes asymmetrical sharpening means which cooperate with internal guide means to ensure the proper placement and sharpening of a large range of crayon sizes. The invention's use of asymmetrical sharpening means and guide means, in addition, permits the efficient reinforcement of the sharpener to resist the forces and stresses generated during the sharpening process.

In one preferred embodiment, the improved sharpener comprises a one-piece, hollow, conical sharpening housing of high impact styrene or other polymeric materials, metals, or combinations of these or similar durable materials. The preferred sharpening housing includes four wall members which converge at one end to form the apex of the conical housing. At the base of the housing, the wall members form an opening to the interior of the housing sized to accommodate crayons with a wide range of diameters.

The sharpening housing is further provided with asymmetrical shaving means for removing layers of surface material from crayons inserted and rotated within the housing. The asymmetrical shaving means preferably comprise a least two shaving slots of differing dimensions. In the preferred embodiment, a first shaving slot is formed in one wall of the sharpening housing and extends from the opening in the base of the housing substantially to the apex of the housing. The first shaving slot is provided with cutting means running the length of the slot including an inwardly extending cutting flange formed along at least one edge of the slot.

A second shaving slot is preferably formed in a wall opposite the first shaving slot and extends a portion of the distance from the opening in the base of the sharpening housing to the apex of the housing. This second, truncated shaving slot is also provided with an inwardly extending cutting flange diagonally opposite the cutting flange of the first shaving slot and extending the length of one edge of the second slot.

The sharpening housing, in addition, includes a guide means, preferably a guide wall opposite the first shaving slot spanning the distance between the terminus of the second, truncated shaving slot and the apex of the shaving housing. This guide wall positions and maintains the leading portion of crayons, particularly relatively thin crayons, in the proper position for sharpening by the shaving means. Thus, the guide means ensures that crayons which would otherwise be difficult to sharpen are shaped to the correct dimensions without undue effort or damage to the crayon.

Of course, more than two shaving slots may also be used in the invention depending on the particular application. The configuration of the guide means may also be altered and the specific dimensions of the shaving and guide means may be varied for different uses.

The conical sharpening housing may also be reinforced with bolster means to strengthen and increase the durability of the device. In the preferred embodiment, bolster means are employed at the base and the apex of the sharpening housing as reinforcing elements. Since the sharpening means are asymmetrical, bolster means may be added to the sharpener without reducing its effectiveness and efficiency. The asymmetrical shaving means themselves may also be provided with bolster means to increase their strength and durability.

The bolster means may include additional structural elements formed in a portion of the housing, such as tabs, ribs or wall portions with an increased thickness. The nature and number of the bolster means will depend on the particular construction and materials used in the sharpener. For example, if a very strong material is used, little or no structural reinforcement may be required, and such bolster means may not be required at all, or their number may be reduced.

The sharpening housing, furthermore, may be provided with engaging means to hold the sharpener in place on an optional container for collecting crayon shavings produced during the sharpening process. The engaging means preferably includes a gripping wall section in spaced relation to the conical sharpening housing and an intermediate section interconnecting the sharpening housing and the gripping wall section.

BRIEF DESCRIPTION OF THE DRAWINGS

For a more complete understanding of this invention, reference should be made to the embodiments illustrated in greater detail in the accompanying drawings and described below by way of examples of the invention. In the drawings:

FIG. 1 is a side view of the improved crayon sharpener showing the preferred embodiment of the sharpener with an optional collection container for holding crayon shavings produced during the sharpening process.

FIG. 2 is an exterior side view of the improved sharpener shown in FIG. 1.

FIG. 3 is an exterior side view showing the opposite side of the improved sharpener shown in FIG. 2.

FIG. 4 is a top view of the improved sharpener shown in FIGS. 1-3.

FIG. 5 is a cross-sectional view of the improved sharpener shown in FIG. 4 along the line 5—5.

FIG. 6 is a cross-sectional view of the improved sharpener shown in FIG. 4 along the line 6—6.

FIG. 7 is a fragmentary cross-sectional view of the improved sharpener shown in FIG. 3 along the line 7—7.

FIG. 8 is a bottom view of the improved sharpener shown in FIG. 1.

FIG. 12 is a perspective view of a prior art crayon sharpener as discussed above.

Figure 9:
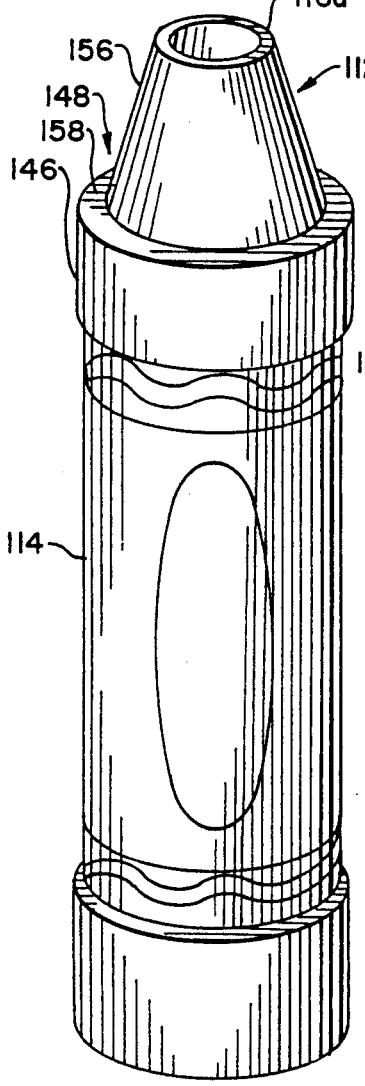
FIG. 9 is a side view of an alternative embodiment of the improved universal crayon sharpener showing the alternative embodiment with an optional collection container for holding crayon shavings produced during the sharpening process.

It should be understood that the drawings are not necessarily to scale. In certain instances, details of the actual structure which are not necessary for the omitted. It should be understood, of course, that the invention is not necessarily limited to the particular embodiments illustrated herein.

DETAILED DESCRIPTION OF THE DRAWINGS

Turning now to the drawings, FIGS. 1 through 8 show a preferred embodiment of the improved, universal crayon sharper. As shown in FIG. 1, the preferred embodiment may include the improved universal sharpener 12 and an optional collection container 14 for holding crayon shavings produced during the sharpening process.

The universal sharpener preferably comprises a one-piece, hollow, conical sharpening housing 16 preferably of high impact styrene or another polymeric material, metals, combinations of metals and plastics or similar durable materials. The specific shape and dimensions of the sharpening housing may be adjusted or altered to suit the particular application.

The sharpening housing 16 is formed of a first curved, sloped wall section 18 and an opposing second curved, sloped wall section 20. The curved wall sections are joined by a first planar, sloped wall section 22 and a second partially planar, sloped wall section 24. At the base of the housing 16, the above-described walls form an opening 26 to the interior of the sharpening housing. This opening 26 is sized to accommodate crayons with a variety of diameters.

In the preferred embodiment, the opening 26 is at least about 0.62 inches in diameter to accommodate the currently commercially available crayons having relatively small (e.g. 0.360 inches) and relatively large (e.g. 0.570 inches) diameters with sufficient clearance for easy use by a child. The size of the opening 26, however, is not limited to that particular diameter and may be increased or decreased for specific applications.

As shown in the drawings, and particularly FIG. 6, the interior surfaces of the wall sections 18, 20, 22 and 24 converge at an angle $\alpha$ from the longitudinal axis x—x of the housing 16 to form the apex 28 of the housing. In the preferred embodiment, the angle $\alpha$ is 15 degrees, although the walls may be at other angles from the axis x—x depending on the particular application. Similarly, the height and shape of the sharpening housing 16 may also be varied depending on the use of the invention.

The sharpening housing 16 is further provided with asymmetrical shaving means for removing layers of surface material from crayons inserted and rotated within the housing. The asymmetrical shaving means preferably comprises at least two shaving slots of differing dimensions. The number and construction of the shaving slots will depend on the particular application of the invention.

In the preferred embodiment, a first shaving slot 30 is formed in the first sloped, planar wall 22 and extends from the opening 26 of the sharpening housing substantially to the apex 28 of the housing. This first shaving 30 slot is provided with cutting means, preferably an inwardly extending cutting flange 32 formed along at least one edge 30*a* of the first shaving slot and extending the length of the slot (see e.g. FIGS. 7 and 8).

The cutting flange 32 is provided with a cutting edge 32*a* formed along its leading surface. The cutting flange 32 extends a sufficient distance into the interior of the conical sharpening housing 16 to engage the surface of a crayon inserted into the housing without pressing the crayon into the shaving opening.

A second, truncated shaving slot 34 is preferably formed opposite the first shaving slot 30 in the partially planar, sloped wall 24. This second shaving slot 34 extends a portion of the distance from the opening 26 of the sharpening housing to the apex 28 of the housing. The second, truncated shaving slot 34 is also provided with an inwardly extending cutting flange 36 extending the length of one edge 34*a* of the second, truncated shaving slot. The second cutting flange 36, like the first cutting flange 32 extends into the center of the sharpening housing 16, and is provided with a cutting edge 36*a*. The second cutting flange 36, in addition, is preferably diagonally opposite the cutting flange 32 of the first shaving slot.

The sharpening housing 16 is further provided with guide means, preferably a guide wall 38 opposite the first shaving slot 30 which spans the distance between the terminus of the second, truncated shaving slot 34 and the apex 28 of the shaving housing. This guide wall 38 also extends across the width of the partially planar, sloped wall 24. The specific dimensions of the guide wall may vary with the dimensions of the second sharpening slot 34 as well as the other dimensions of the improved sharpener 12.

The guide wall 38 is disposed to engage the leading portion of crayons, particularly relatively thin crayons, to orient and maintain the crayons in the proper sharpening position relative to the cutting flanges 32 and 36 of the shaving slots 30 and 34. The action of the guide wall 38 reduces or eliminates the likelihood of improper positioning of crayons within the sharpener and unacceptable movement of crayons during the sharpening process.

To sharpen a crayon or similar marking instrument, the crayon is inserted into the sharpening housing 16 and is then rotated against the cutting flanges 32 and 36. The flange cutting edges 32*a* and 36*a* initially remove rough edges or irregularities in the crayon surface to shape the crayon into a rough conical form. Then, they further shape the crayon to adjust the slope of the sides of the crayon to the angle $\alpha$ of the sharpening housing walls (see FIG. 6). It is frequently during this final stage that the asymmetrical sharpening means and guide means are most helpful in maintaining the position of the crayon without undue damage to or breakage of the marking instrument.

The shavings produced by the cutting edges 32*a* and 36*a* pass out of the sharpening housing 16 through shaving slots 30 and 32. They may then be collected in the optional collection container 14.

As the sharpener must operate on both large and small diameter crayons, the sharpening housing is preferably strengthened with reinforcing or bolster means. In the preferred embodiment, a bolster portion 40 strengthens the apex 28 and the second partially planar, sloped wall 24 of the sharpening housing 16. Thus, the exterior of the second wall section 24 includes a first, planar wall portion 24*a* sloped at approximately the same angle as the first wall section 22, a second planar wall portion 24*b* at an angle normal to the base of the sharpening housing, and a third curved wall portion 24*c* sloped to the same angle as the first planer, sloped wall section 24*a*.

Since the shaving means are asymmetrical, the bolster portion 40 may be added to the sharpener without interfering with sharpening function of the first and second shaving slots and their cutting flanges. Moreover, the edge 30*a* of the first shaving slot 30 may also be strengthened with a reinforcing strip 42. A strengthening tab (or tabs) 44, in addition, may be employed to further support and reinforce the sharpening housing 16.

In the preferred embodiment, bolster means such as the bolster portion 40, the reinforcing strip 42 and strengthening tab 44, are formed with and of the same material as the sharpening housing 16, although they may also be separate elements and may be composed of other materials. The bolster means may also include further structural elements formed in a portion of the housing, such as additional tabs, ribs or wall portions with an increased thickness. The nature and number of the bolster means will depend on the particular construction and materials used in the sharpener. For example, if a very strong material is used, little or no structural reinforcement may be required and the bolster means may not be required at all, or their number may be reduced.

The sharpening housing 16, in addition, may be provided with engaging means to hold the housing in place on the optional collection container 14. The engaging means preferably includes a gripping wall section 46 in spaced relation to the conical sharpening housing 16 and an intermediate section 48 interconnecting the sharpening housing 16 and the gripping wall section 46. The intermediate section 48 may also be provided with V-shaped teeth 50 to interlock with cooperating locking teeth on the bottom edge of the collection container 14 to hold the sharpening housing in place during its operation.

To aid in placing crayons and other similar marking instruments within the sharpening housing 16, the base of the sharpening housing 16 may also be provided with a depending, circumferential flange member 52 extending below the intermediate section 48. Similarly, the gripping wall section 46 may be provided with a flange member 54 extending below the intermediate section 48. The flange member 54 strengthens the gripping wall 46 and provides a base for the support of the improved sharpening device when it is set on end.

Figure 11:
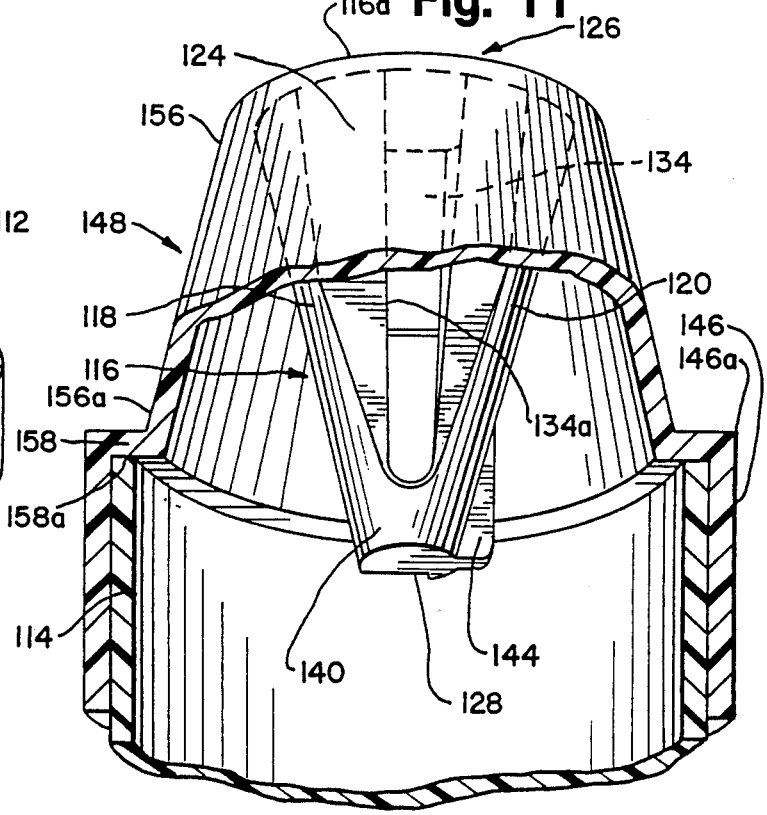
FIG. 11 is an exterior side view showing the opposite side of the alternative embodiment shown in FIG. 10.
Figure 10:
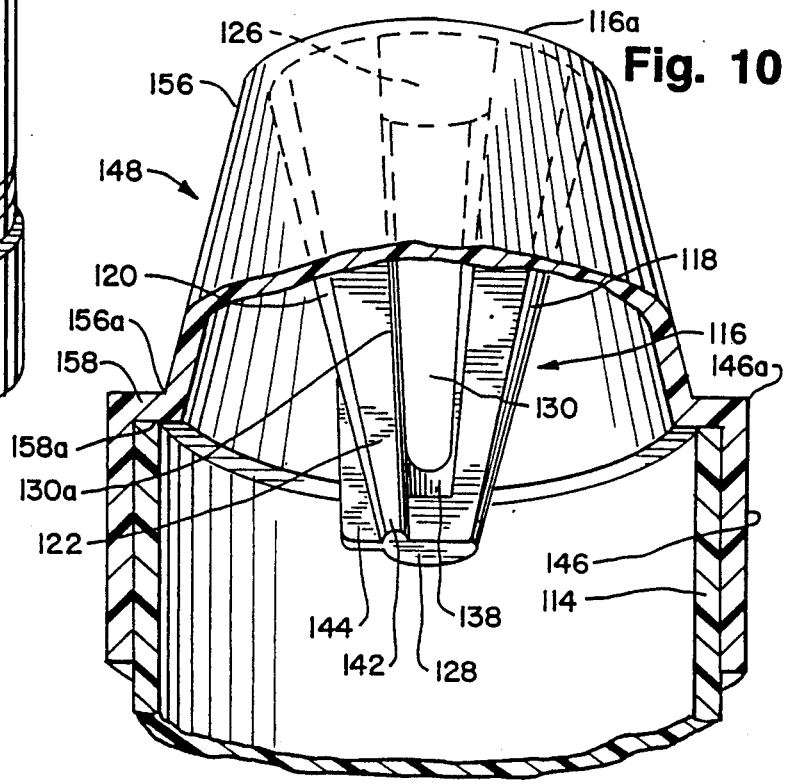
FIG. 10 is an exterior side view of the alternative embodiment shown in FIG. 9.

An alternative embodiment of the improved universal crayon sharpener 112 is shown in FIGS. 9–11. In this embodiment, the sharpener 112 is located at one end of an optional collection container 114 in the shape of a crayon. As shown in FIGS. 9 and 10, the sharpening housing 116 is similar to that shown in FIGS. 2–8 discussed above. The sharpening housing 116 includes curved, sloped wall sections 118 and 120, as well as a first planar sloped wall section 122 and a second partially planar, sloped wall section 124. These wall sections, as discussed above, form an opening 126 to the interior of the sharpening housing and form the apex 128 of the housing.

The sharpening housing 116 is further provided with asymmetrical shaving means including a first shaving slot 130 and second truncated shaving slot 134. The first and second shaving slots are provided with cutting means including opposing cutting flanges formed along at least one edge 132*a* and 134*a* of the shaving slots.

The sharpening housing 116 is also provided with a guide wall 138 to engage and maintain the leading portion of crayons in the proper sharpening position. The sharpening housing 116, in addition, may be provided with reinforcing means such as a bolster portion 140, reinforcing strip 142 and strengthening tab 144.

In this embodiment, alternative engaging means are employed to hold the sharpener 112 on the optional collection container 114. The alternative engaging means resemble the "tip" of a crayon and allow the user to set the collection container 114 on its opposite end without the loss or spillage of crayon shavings from the interior of the container. The alternative engaging means preferably include a gripping wall section 146 in spaced relation to the conical sharpening housing 116. An intermediate section 148 interconnects the sharpening housing 116 and the gripping wall section 146.

The intermediate section 148 is provided with an annular skirt member 156 connected to the outer periphery 116*a* of the base of the sharpening housing 116. The skirt member 156 extends downwardly and outwardly from the base of the sharpening housing 116 to an annular ledge 158 connected to the periphery 156*a* of the skirt member. The ledge 158 extends outwardly from the periphery 156*a* of the skirt member to the gripping wall section 146. The ledge 158 joins the gripping wall section 146 at the upper edge 146*a* of the gripping wall to connect the gripping wall 116 with the skirt member 156.

The inner face 158*a* of the ledge may also be provided with V-shaped teeth (not shown). These teeth may cooperate with locking teeth on the edge of the collection container 114 to hold the sharpening housing in place during its operation.

Thus, the device described above provides an improved, universal crayon sharpener that is capable of sharpening crayons with a variety of diameters in a simple compact form. The improved sharpener is reinforced, durable and cost efficient. The sharpener is provided with a construction that accommodates crayons of many different sizes in the proper sharpening position and works with an optional collection container to prevent undue spillage of crayon shavings.

While the invention has been described by reference to certain specific descriptions and examples which illustrate preferred materials, configurations and conditions, it is understood that the invention is not limited thereto. Rather, all alternatives, modifications and equivalents within the scope and spirit of the invention so described are considered to be within the scope of the appended claims.

What is claimed is:

1. An improved device for sharpening crayons and similar marking instruments inserted and rotated within the device comprising:

a hollow, conical sharpening housing with upper portions converging to form the apex of the housing and lower portions forming an opening at the base of the housing sized for receiving crayons of different diameters with the housing;

asymmetrical shaving means for removing a portion of the surface of crayons rotated within the sharpening housing, including at least two shaving means, the first shaving means extending from the opening at the base of the sharpening housing substantially to the apex of the housing and the second shaving means extending a portion of the distance from the opening at the base of the housing to the apex of the housing; and guide means comprising a guide wall extending from the terminus of the second shaving means substantially to the apex of the housing disposed to engage and maintain the leading portion of crayons in the proper sharpening position with respect to the asymmetrical shaving means.

2. The improved device for sharpening crayons and other marking instruments of claim 1 wherein the first shaving means includes a first shaving slot provided with cutting means extending the length of the first slot, and the second shaving means includes a second shaving slot provided with cutting means diagonally opposite the cutting means of the first shaving slot extending the length of the second slot.

3. The improved device for sharpening crayons and other marking instruments of claim 2 wherein the cutting means of the first and second shaving slots comprise inwardly extending cutting flanges formed along at least one edge of the shaving slots.

4. The improved device for sharpening crayons and other marking instruments of claim 1 wherein the sharpening housing is provided with reinforcing means comprising at least one bolster portion disposed between the terminus of the second shaving means and the apex of the sharpening housing and at least one reinforcing strip adjacent to and coextensive with at least one of the shaving means.

5. An improved device for sharpening crayons and similar marking instruments inserted and rotated within the device comprising:

a hollow, conical sharpening housing with a central vertical axis X—X, including a first curved wall section and a second curved wall section opposite the first wall section, the curved wall sections joined by a first planar wall section sloped at a first angle to the vertical axis X—X and a second planar wall section sloped at a second angle to the vertical axis X—X, the upper portions of the curved and planar wall sections converging to form the apex of the housing and the lower portions of the curved and planar wall sections forming an opening at the base of the housing sized for receiving crayons of different diameters within the housing;

asymmetrical shaving means for removing a portion of the surface of crayons rotated within the sharpening housing, including at least a first shaving means extending from the opening at the base of the housing to substantially the apex of the housing and at least a second, opposing shaving means extending a portion of the distance from the opening at the base of the sharpening housing to the apex of the housing; and guide means comprising a guide wall extending from the terminus of the second shaving means substantially to the apex of the sharpening housing disposed to engage and maintain the leading portion of crayons in the proper sharpening position with respect to the asymmetrical shaving means.

6. The improved device for sharpening crayons and other marking instruments of claim 5 wherein the device is provided with engaging means for releasably securing the sharpening housing to a collecting container comprising a gripping wall section in spaced relation to the sharpening housing for frictionally engaging the collection container and an annular intermediate section interconnecting the sharpening housing and the gripping wall section, the intermediate section provided with a plurality of radially oriented gripping teeth disposed for releasable frictional engagement of corresponding radially oriented gripping teeth on the collection container when pressure in exerted upon the sharpening housing inhibiting the movement of the sharpening housing during the sharpening process.

7. The improved device for sharpening crayons and other marking instruments of claim 5 wherein the sharpening housing is provided a circumferential guide flange depending from the base of the housing.

8. An improved device for sharpening crayons and similar marking instruments inserted and rotated within the device comprising:

a hollow, conical sharpening housing with a central vertical axis X—X, including a first curved wall section and a second curved wall section opposite the first wall section, the curved wall sections joined by a first planar wall section sloped at a first angle to the vertical axis X—X and a second planar wall section sloped at a second angle to the vertical axis X—X, the upper portions of the curved and planar wall sections converging to form the apex of the housing and the lower portions of the curved and planar wall sections forming an opening at the base of the housing sized for receiving crayons of different diameters within the housing;

asymmetrical shaving means for removing a portion of the surface of crayons rotated within the sharpening housing, including at least a first shaving means formed in the first planar wall section extending from the opening at the base of the housing to substantially the apex of the housing and at least a second, opposing shaving means formed in the second planar wall section extending a portion of the distance from the opening at the base of the sharpening housing to the apex of the housing;

a guide wall extending from the terminus of the second shaving means substantially to the apex of the sharpening housing disposed to engage and maintain a leading portion of crayons in the proper sharpening position with respect to the asymmetrical shaving means; and engaging means for releasably securing the sharpening housing to a collection container comprising a gripping wall section in spaced relation to the sharpening housing for frictionally engaging the collection container and an intermediate section interconnecting the sharpening housing and the gripping wall section, the intermediate section including an annular skirt member extending downwardly and outwardly from the base of the sharpening housing and an outwardly extending annular ledge interconnecting the gripping wall section and the periphery of the annular skirt member.

9. The improved device for sharpening crayons and other marking instruments of claim 1 wherein the opening formed by the lower portions of the sharpening housing is approximately 0.62 inches in diameter to accommodate crayons with diameters from 0.36 inches to 0.57 inches.

10. The improved device for sharpening crayons and other marking instruments of claim 5 wherein the opening formed by the curved and planar wall sections is approximately 0.62 inches in diameter to accommodate crayons with diameters form 0.36 inches to 0.57 inches.

11. The improved device for sharpening crayons and other marking instruments of claim 5 wherein the second planar wall section includes a curved upper bolster portion between the terminus of the second shaving means and the apex of the sharpening housing.

12. The improved device for sharpening crayons and other marking instruments of claim 5 wherein the sharpening housing is provided with reinforcing means comprising bolster portions disposed between the terminus of the second shaving means and the apex of the sharpening housing and a reinforcing strip adjacent to and coextensive with the first sharpening means extending substantially the length of the first sharpening means.

13. The improved device for sharpening crayons and other marking instruments of claim 5 wherein the second planar wall section comprises a fist sloped planar segment extending from the base of the housing to a first intermediate point between the base and the apex of the housing; a second planar bolster segment extending parallel to the vertical axis X—X from the first intermediate point to a second intermediate point between the base and apex of the housing; and a third sloped, curved bolster segment extending from the second intermediate point substantially to the apex of the housing.

14. The improved device for sharpening crayons and other marking instruments of claim 13 wherein the second intermediate point is at approximately the terminus of the second sharpening means.

15. The improved device for sharpening crayons and other marking instruments of claim 8 wherein the opening formed by the curved and planar wall sections is approximately 0.62 inches in diameter to accommodate crayons with diameters from 0.36 inches to 0.57 inches.

16. The improved device for sharpening crayons and other marking instruments of claim 8, wherein the sharpening housing is provided with reinforcing mans comprising bolster portions disposed between the terminus of the second shaving means and the apex of the sharpening housing and a reinforcing strip adjacent to and coextensive with the first sharpening means extending substantially the length of the first sharpening means.

17. The improved device for sharpening crayons and other marking instruments of claim 8 wherein the sharpening housing is provided with reinforcing means comprising a reinforcing strip adjacent to and coextensive with the first sharpening means extending substantially the length of the first sharpening means; and a planar bolster segment extending parallel to the vertical axis X—X from a first intermediate point on the second planar wall section between the base and apex of the housing to a second intermediate point at approximately the terminus of the second sharpening means; and a sloped, curved bolster segment extending from the second intermediate point substantially to the apex of the housing.

18. The improved device for sharpening crayons and other marking instruments of claim 8 wherein the annular ledge is provided with a plurality of radially oriented ripping teeth disposed for releasable frictional engagement with corresponding radially oriented gripping teeth on the collection container when pressure is exerted upon the sharpening housing inhibiting the movement of the sharpening housing during the sharpening process.

* * * * *

UNITED STATES PATENT AND TRADEMARK OFFICE

CERTIFICATE OF CORRECTION

PATENT NO. : 4,991,299

DATED : February 12, 1991

INVENTOR(S) : Charles W. Dietterich, et al

It is certified that error appears in the above-identified patent and that said Letters Patent is hereby corrected as shown below:

On the title page:

Title page, col. 1, line 6, "all of" should be -- all of Pennsylvania--

Title page, col. 1, line 30, "Co, it is" should be --Co. It is--

Title page, col. 2, line 23, "wal" should --wall--

Col. 4, line 19, "the omitted" should be --the understanding of the present invention may have been omitted.--

Col. 5, line 68, "through shaving" should be --through the shaving--

Col. 8, line 5, "with" should be --within--

Col. 10, line 27, "fist" should be --first--

Col. 10, line 47, "mans" should be --means--

Signed and Sealed this

Twenty-ninth Day of September, 1992

*Attest:*

DOUGLAS B. COMER

*Attesting Officer*

*Acting Commissioner of Patents and Trademarks*